US006182960B1

(12) United States Patent
Keller et al.

(10) Patent No.: US 6,182,960 B1
(45) Date of Patent: Feb. 6, 2001

(54) APPARATUS FOR PROCESSING FLEXIBLE, SHEET-LIKE PRODUCTS

(75) Inventors: Alex Keller, Eschenback; Roberto Fenile, Wetzikon, both of (CH)

(73) Assignee: Ferag AG, Hinwil (CH)

( * ) Notice: Under 35 U.S.C. 154(b), the term of this patent shall be extended for 0 days.

(21) Appl. No.: 09/255,457

(22) Filed: Feb. 19, 1999

(30) Foreign Application Priority Data

Feb. 27, 1998 (CH) ..... 0476/98

(51) Int. Cl.[7] ..... B65H 5/12

(52) U.S. Cl. ..... 271/82; 271/69; 271/107; 271/151; 198/470.1

(58) Field of Search ..... 271/82, 151, 107, 271/18, 69, 30.1, 204, 206; 198/470.1, 471.1, 434, 644

(56) References Cited

U.S. PATENT DOCUMENTS

| | | | | |
|---|---|---|---|---|
| 4,201,286 | | 5/1980 | Meir | 198/461 |
| 4,320,894 | | 3/1982 | Reist et al. | 271/277 |
| 4,566,687 | * | 1/1986 | Faltin | 271/151 |
| 4,895,360 | | 1/1990 | Reist | 271/202 |
| 4,896,874 | | 1/1990 | Müller | 271/186 |
| 5,110,108 | * | 5/1992 | Muller | 271/82 |
| 5,398,920 | * | 3/1995 | Leu | 271/107 |
| 5,494,274 | * | 2/1996 | Hansh | 271/107 |
| 5,542,656 | | 8/1996 | Stauber | 271/11 |

FOREIGN PATENT DOCUMENTS

| | | |
|---|---|---|
| 847 439 | 8/1952 | (DE) . |
| 0 499 691 | 8/1992 | (EP) . |
| 0 638 503 | 9/1996 | (EP) . |
| 0 790 203 | 8/1997 | (EP) . |
| 2 555 938 | 6/1985 | (FR) . |
| 1 407 026 | 9/1975 | (GB) . |

* cited by examiner

*Primary Examiner*—John M. Jillions
(74) *Attorney, Agent, or Firm*—Alston & Bird LLP

(57) ABSTRACT

The apparatus for processing flexible, sheet-like products (14) has a feed conveyor (12) which is intended for feeding the products (14) to an intermediate conveyor (18). The latter has pivotably controlled grippers (22) arranged one behind the other and moved along a continuous circulatory path (26) in the direction of circulation (U). The intermediate conveyor (18) is intended for altering the position of the fed products (14), while the sequence of the products remains unaltered, such that the previously mutually facing sides of adjacent products (14) are reversed, and then for transferring the products to a removal conveyor (38). For this purpose, each gripper (22) is controlled such that the product (14) retained by it is drawn around the following gripper (22) as seen in the direction of circulation (U), from one side of the gripper to the other side.

13 Claims, 5 Drawing Sheets

APPARATUS FOR PROCESSING FLEXIBLE, SHEET-LIKE PRODUCTS

BACKGROUND OF THE INVENTION

The present invention relates to an apparatus for processing flexible, sheet-like products, such as printed products.

An apparatus of the described type is disclosed in EP-A-0 300 170 and in the corresponding U.S. Pat. No. 4,895,360. This apparatus has a feed conveyor which is intended for feeding printed products to an intermediate conveyor in an imbricated formation in which each printed product rests, in the manner of roof tiles, on the following product. The intermediate conveyor has grippers which are arranged on a buffer chain and are moved along a continuous, banana-shaped circulatory path in the direction of circulation. Arranged downstream of the intermediate conveyor is a removal conveyor, of which the clamps are intended for receiving the printed products from the grippers, and conveying the products away, in a hanging position. Between the feed conveyor and the removal conveyor, the buffer chain is controlled such that, in an approximately horizontally running section of the circulatory path, the distance between the grippers increases, with the result that the printed product retained by the respectively preceding gripper is separated from the printed product retained by the following gripper and falls into an obliquely rearwardly directed hanging position. In a following section of the circulatory path, the distance between successive grippers is reduced again, with the result that, while the sequence of the printed products remains the same, the previously oppositely facing sides of the printed products are then directed toward one another. In order for it to be possible for the printed products to be separated from one another in the direction of circulation, the intermediate conveyor of the known apparatus requires a considerable overall length, which affects the amount of space required by the apparatus.

An object of the present invention is to provide an apparatus of the described type which requires a considerably smaller amount of space.

SUMMARY OF THE INVENTION

The above and other objects and advantages of the present invention are achieved by the provision of an apparatus which comprises a feed conveyor for supplying the products to a receiving location, and an intermediate conveyor which includes a plurality of pivotably controlled grippers arranged for movement serially along a continuous circulatory path in a direction of circulation. Each of the grippers includes means for gripping the leading product from the feed conveyor and for guiding the gripped product around the following grippers in the direction of circulation so that the gripped product moves from one side of the following gripper to the other side as the gripped product moves along the continuous circulatory path. Also, the sequence of the products remains intact and the mutually facing sides of adjacent products are reversed. The apparatus further comprises a removal conveyor arranged downstream of the intermediate conveyor for receiving the products from the grippers and conveying them away.

The apparatus makes use of the ability of flexible products to bend and the products, by being drawn around the respectively following gripper, are moved to the other side of said gripper. This means that the distance between successive grippers can be maintained. In any case, this distance need not be increased to the extent where the successive products, as seen in the direction of circulation, are separated from one another.

BRIEF DESCRIPTION OF THE DRAWINGS

The invention is explained in more detail with reference to exemplary embodiments illustrated in the drawings, in which, purely schematically.

DETAILED DESCRIPTION OF THE PREFERRED EMBODIMENTS

Figure 1:
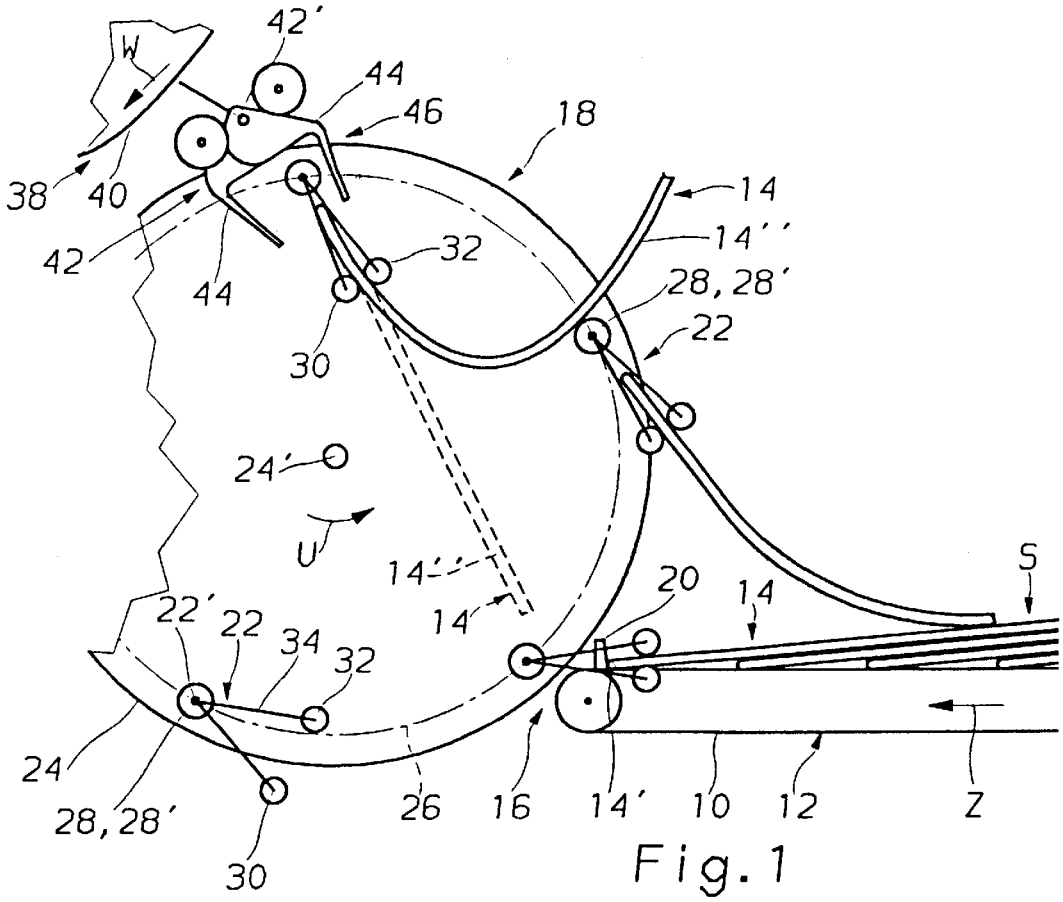
FIG. 1 shows, in elevation and in vastly simplified form, a first embodiment of an apparatus according to the invention, in which flexible sheet-like products are fed in imbricated formation to an intermediate conveyor and, by means of the grippers of the latter, are drawn, around the respectively following gripper, to the other side.

The apparatus which is shown in FIG. 1 has a feed conveyor 12 which is designed as a belt conveyor 10, is driven in the feed direction Z and is intended for feeding flexible, sheet-like products 14, in the present case printed products, such as periodicals, newspapers or the like, in an imbricated formation S, in which each product rests on the respectively following product, to a receiving location 16 of an intermediate conveyor 18. Arranged at the receiving location 16, at the end of the belt conveyor 10, is a stop 20 which is assigned to said conveyor and against which in each case the leading product 14 of the imbricated formation S, as seen in the feed direction Z, passes into abutment by way of its leading edge 14', in the present case the fold region of the folded products 14.

The intermediate conveyor 18 has individually controlled grippers 22, which are mounted in a pivotably controlled manner on a disc-like carrying wheel 24, which is driven continuously in rotation about its center axis 24' in the direction of circulation U. The pivot axes 22' of the grippers 22, said axes running parallel to the axis 24', cross over a circle which is coaxial with respect to the axis 24' and are distributed uniformly one behind the other in the circumferential direction. The circulatory path, designated by 26, of the pivot axes 22' of the grippers 22 is thus a circular path.

The axis 24' is located above the belt conveyor 10 and the direction of circulation U is selected such that, once they have passed through the lowermost point of the circulatory path 26, the grippers 22 move towards the receiving location 16, in order, by way of an open gripper 22 which is pivoted counter to the feed direction Z, to grasp in each case that product 14 which is butting against the stop 20 and, by closing the gripper 22, to secure said product and peel it off in the upward direction from the following product 14; for the peeling off operation, the grippers 22 are pivoted counter to the direction of circulation U.

Figure 6:
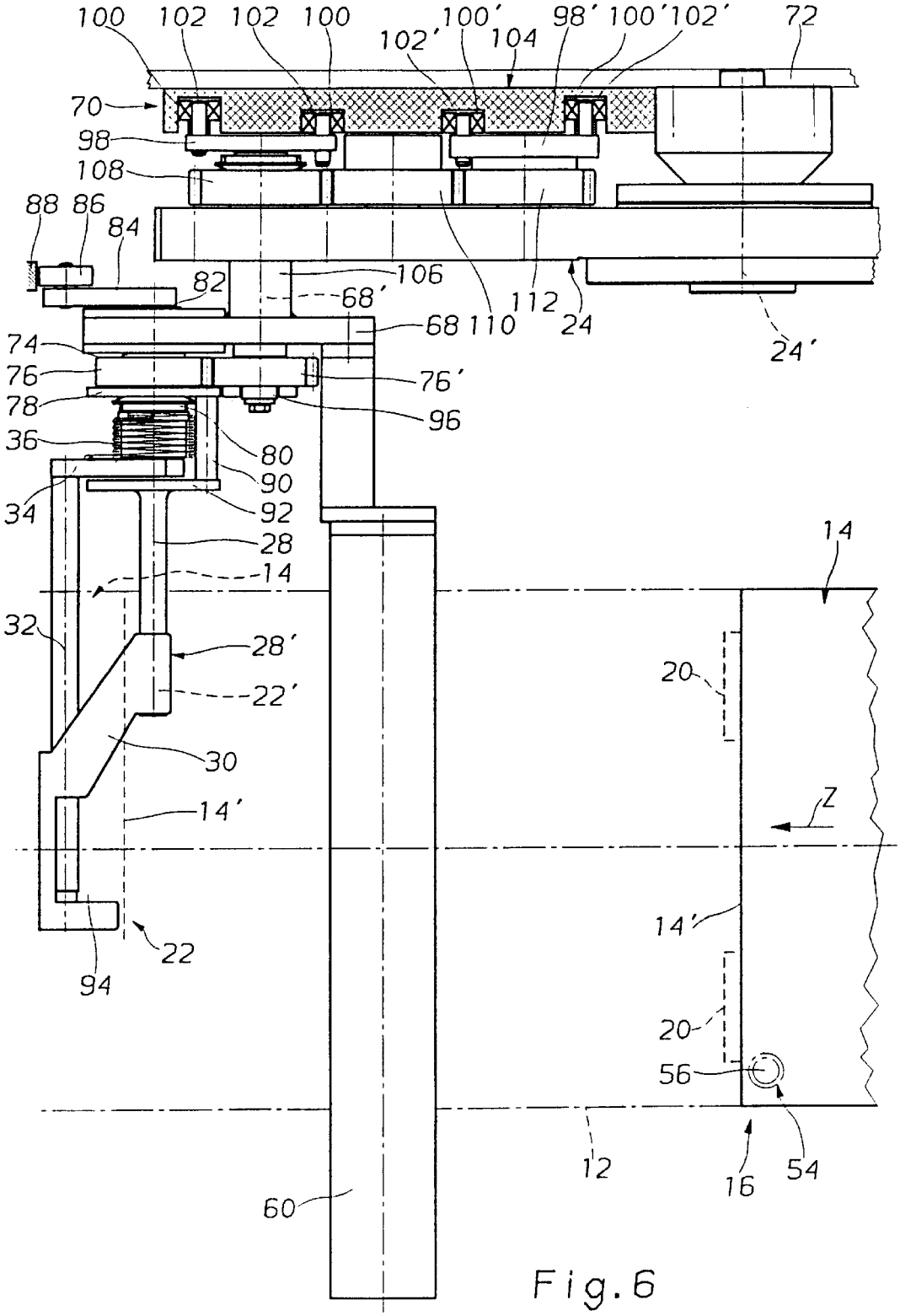
FIG. 6 shows a plan view, partially in section, of part of that embodiment of the apparatus which is shown in FIG. 5.

Each gripper 22 has a shaft 28, of which the longitudinal axis coincides with the pivot axis 22' of the gripper 22 and which projects from the carrying wheel 24, which is arranged to the side of the belt conveyor 10, as seen in the feed direction Z. Fastened at the free end of the shaft 28, in the manner of a lever, is a gripper tongue 30 which is intended for interacting with a gripper jaw 32, which is of bar-like design. At the end which is directed toward the carrying wheel 24, said gripper jaw is fastened on a lever 34, which is mounted pivotably about the pivot axis 22' and is pre-stressed in the closing direction of the gripper 22, for example, by means of a closing spring 36. A gripper 22 of this type is shown in FIG. 6 and will be described in more detail hereinbelow. The gripper tongue 30 is located in the central region of the belt conveyor 12, as seen in the direction at right angles to the feed direction Z.

As the gripper 22 pivots further counter to the direction of circulation U, with the carrying wheel 24 continuing to rotate continuously, until said gripper reaches approximately the highest point of the circulatory path 26, the gripper 22 is pivoted, out of a pivot position in which it is oriented radially outside the following gripper in a direction in which it is oriented more or less radially inward. During this pivot movement, the product 14 retained by the respectively preceding gripper 22 passes into abutment, by way of its radially inner side, against the shaft 28 of the respectively following gripper 22 and, with a bending action, is drawn around the shaft 28 until it is arranged to the full extent radially within the following gripper 22, as is indicated by dash lines in FIG. 1. In this case, the shaft 28 of the respectively following gripper 22 forms a supporting element 28' for the product 14 retained by the preceding gripper 22.

As a result of the product 14 being drawn around the following gripper 22, the side 14", which was previously is directed towards the following product 14, comes to be located on the side which is directed away from said product.

Arranged downstream of the intermediate conveyor 18 is a removal conveyor 38 which has clamps 42 spaced apart one behind the other on a drawing element 40, which is driven in circulation in the removal direction W, said clamps being disclosed, for example, in EP-A-0 600 183 and the corresponding U.S. Pat. No. 5,395,151. These clamps have two pivotably mounted clamp jaws 44 which can be pivoted about a clamp axis 42' running at right angles to the removal direction W, from an open position, which is shown in FIG. 1, into a closed position and back. In the transfer region 46 of the intermediate conveyor 18, said transfer region being located at the top of the carrying wheel 24, the direction of circulation U runs in the same direction as the removal direction W, and the speed of circulation of the grippers 22 and spacings between the grippers 22 are coordinated with the removal speed and the spacings between the clamps 42 such that, in the transfer region 46, a clamp 42 coincides with each gripper 22, in order for the product 14 retained by the gripper 22 to have the clamp 42 engaging around it from the edge 14' and to be secured, in order to be transported away, by the clamp jaws 44 being moved into the closed position. Once the gripper 22 has been opened, the product 14, which is then retained by the clamp 42, is conveyed away in the same direction, in relation to the gripper 22, through the spaced-apart gripper tongue 30 and gripper jaw 32 as is the case at the receiving location 16, when the product 14 is introduced into the gripper 22.

The movement path of the clamp 42 runs in the same plane as the movement path of the gripper tongue 30—see FIG. 6—it being the case, as seen in elevation, that the movement path of the clamps 42 intersects the circulatory path 26. This ensures in a straightforward manner that that section of the product 14 which projects beyond the gripper tongue 30 and the gripper jaw 32 in the direction of the shaft 28 is introduced without any difficulty into the clamp 42.

Figure 2:
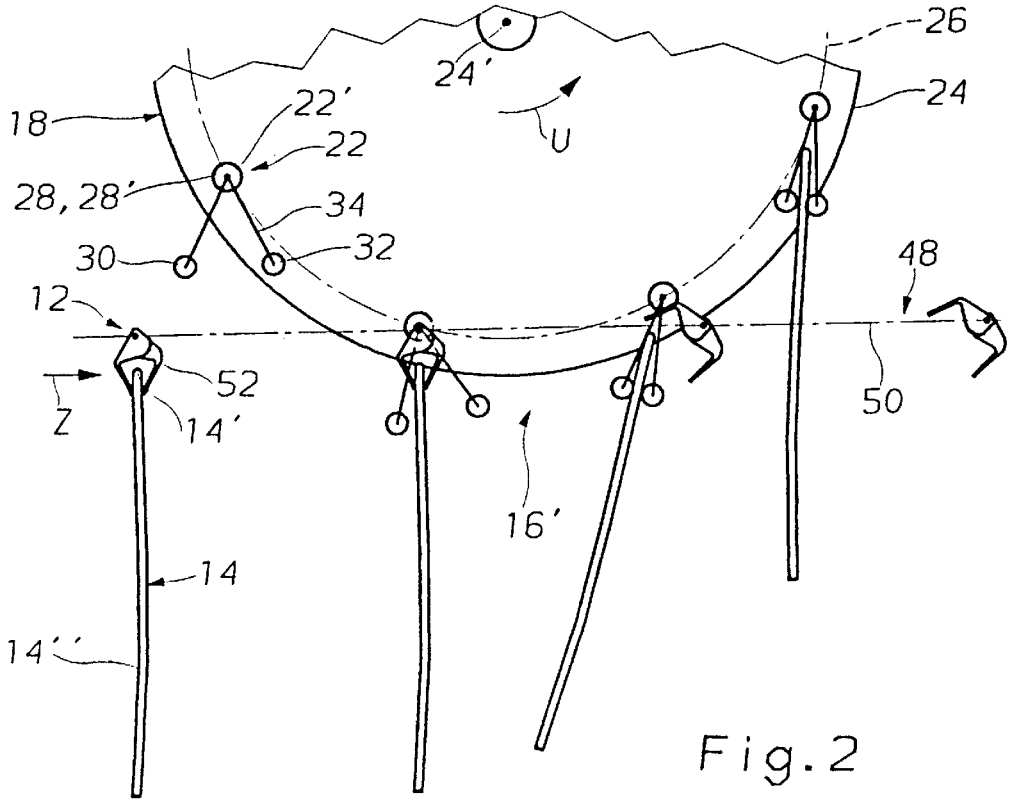
FIG. 2 shows, in elevation, part of a second embodiment of the apparatus, in which the products are fed to the intermediate conveyor in a hanging position by means of a clamp-type transporter.

In that embodiment of the apparatus which is shown in FIG. 2, the feed conveyor 12 is formed by a clamp-type transporter 48 which has transporting clamps 52 spaced apart one behind the other on a drawing element 50 which is driven in circulation in the feed direction Z—this runs in the same direction as the direction of circulation U. In the receiving region 16', the clamp-type transporter 48 runs in the horizontal direction and the downwardly directed transporting clamps 52 are intended for retaining the products 14 at the top edge 14' in a hanging position.

The intermediate conveyor 18 and the removal conveyor 38 are designed in the same way as in the embodiment shown in FIG. 1, with the exception of the pivot control means for the grippers 22 of the intermediate conveyor 18 located in the bottom region of the circulatory path 26, said region being directed toward the receiving region 16'. In that section of the circulatory path 26 which follows the transfer region 46 (see FIG. 1), the grippers 22, in the exemplary embodiment shown in FIG. 2, are pivoted in the downward direction, with the result that the relevant product 14, which is retained by a transporting clamp 52, is enclosed from above, from its edge 14', by the gripper tongue 30 on one side and by the gripper jaw 32 on the other side. Once the gripper 22 has been closed, this taking place approximately vertically beneath the axis 24', the relevant transporting clamp 52 is opened and by virtue of pivoting, and as a result of the higher speed, as seen in the feed direction Z, in relation to the speed of the relevant gripper 22, is moved out of the region of said gripper. Downstream of the receiving region 16', as seen in the direction of circulation U, the grippers 22, in the same way as is shown in FIG. 1, are pivoted further, between said receiving region and the transfer region 46, counter to the direction of circulation U, in order to change the imbricated formation of the relevant products 14 by drawing them around the respectively following gripper 22.

Figure 3:
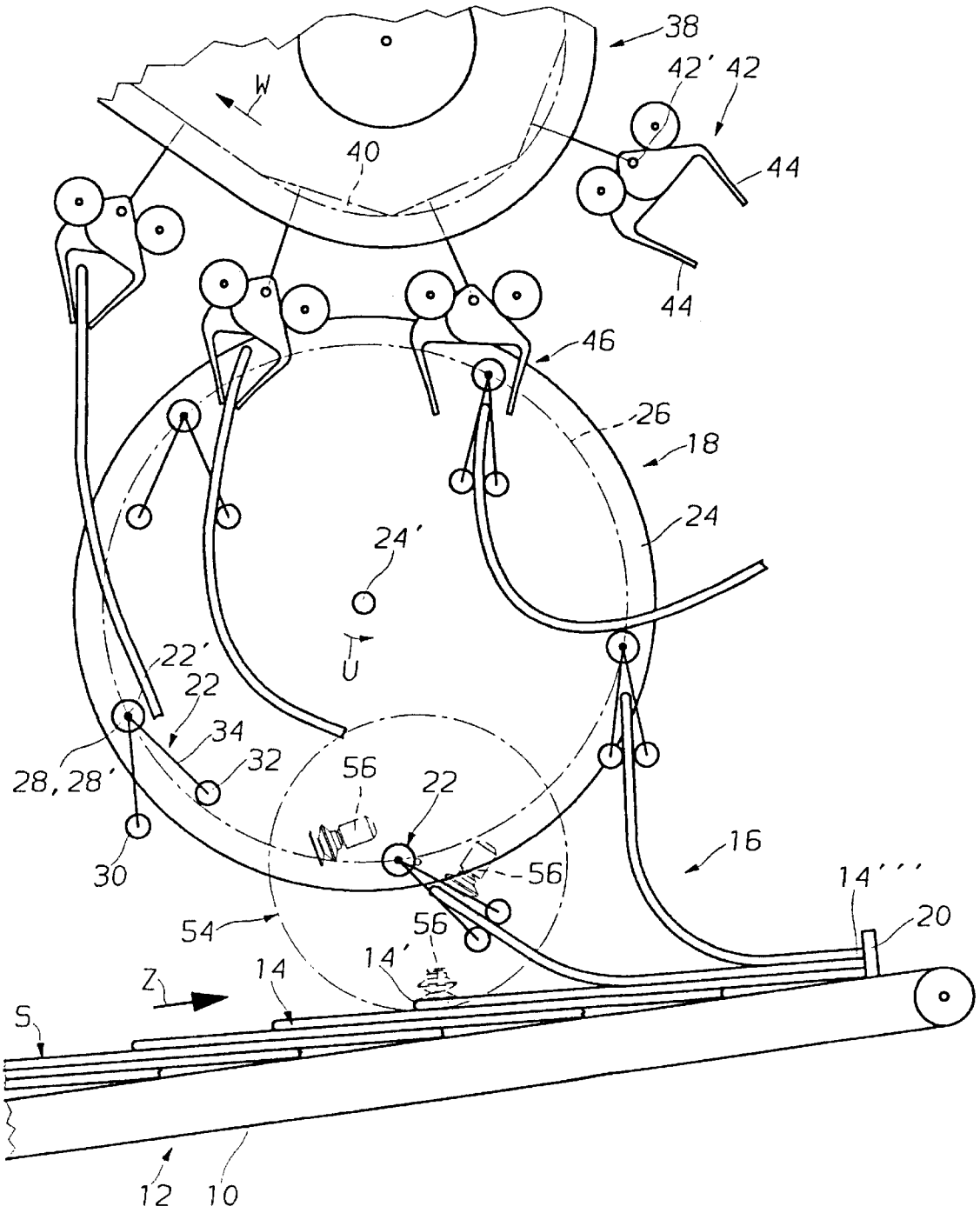
FIG. 3 shows, in elevation, a further embodiment of the apparatus, with the products being fed in imbricated formation and being lifted into the movement path of the grippers of the intermediate conveyor by means of a sucker arrangement.

In that embodiment of the apparatus which is shown in FIG. 3, the feed conveyor 12 is designed, once again, as a belt conveyor 10 which is intended for feeding the products 14, which are arranged in an imbricated formation S in which, once again, each product 14 rests, in the manner of roof tiles, on the respectively following product 14, to the receiving location 16 in the feed direction Z. At the receiving location 16 in this case the feed direction Z runs in the same direction as the direction of circulation U of the intermediate conveyor 18, but the fold region of the folded products 14 now forms the trailing edge 14', with the result that said products pass into abutment against stop 20 by way of the leading edge 14'", which is located opposite said edge 14' and in the case of folded printed products is the so-called bloom. The intermediate conveyor 18, which is designed in the same way as is shown in FIG. 1, is in this case arranged, in its entirety, above the belt conveyor 10, and the latter is assigned a sucker arrangement 54 as is known, for example, from EP-A-0 628 505 and the corresponding U.S. Pat. No. 5,542,656. As far as construction and functioning are concerned, reference is made to these documents which are incorporated by reference. The sucker arrangement 54 has suction heads 56 which are intended for being positioned from above against the exposed side of the product 14 butting against the stop 20, this taking place at the edge 14' of said product, and, as a result of being connected to a negative-pressure source, for securing and lifting said product, with the result that, similarly to the case shown in FIG. 1, in each case one gripper 22 of the intermediate conveyor 18 can grip the product 14 and can peel it off in the upward direction from the following product 14. The relevant suction head 56 has air admitted to it as soon as the gripper 22 has gripped the product 14. Between the receiving location 16 and the transfer region 46, as seen in the direction of circulation U, the grippers 22, once again, are pivoted counter to the direction of circulation U, in order for the products 14 to be drawn around the respectively following gripper 22 from the radially outer side of said gripper to the radially inner side thereof and thus of the following product 14. Transfer to the removal conveyor 38 takes place in the same way as has been described in conjunction with the exemplary embodiment shown in FIG. 1.

Figure 4:
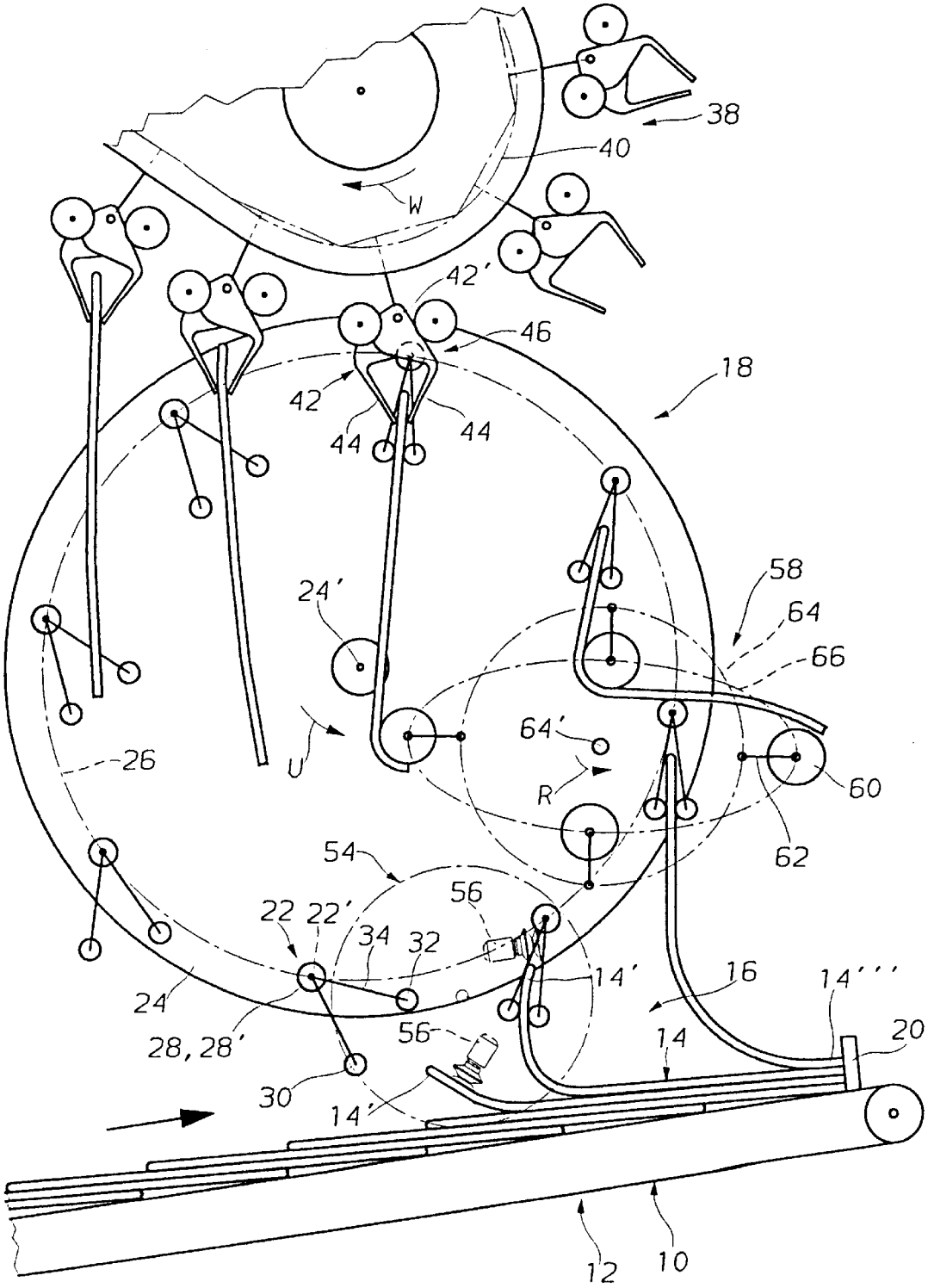
FIG. 4 shows, likewise in elevation, a further embodiment of the apparatus, this being very similar to the embodiment shown in FIG. 3 but additionally having pressure-exerting elements which circulate along a continuous movement path in order to draw the products around the grippers.

In the embodiment shown in FIG. 4, the feed conveyor 12, the sucker arrangement 54, the intermediate conveyor 18 and the removal conveyor 38 are of basically the same design as in the embodiment shown in FIG. 3, the only difference being that more grippers 22 are arranged, at smaller distances apart from one another, on the carrying wheel 24. Arranged between the sucker arrangement 54 and the transfer region 46, as seen in the direction of circulation U, is a pressure-exerting device 58, which has four circular-cylindrical pressure-exerting elements 60, of which the longitudinal axes run parallel to the axis 24' of the carrying wheel 24. By way of their end which is directed away from the carrying wheel 24, the pressure-exerting elements 60 are each fastened on a pivot lever 62 which, by way of its other end, is mounted rotably on a rotor 64. As seen in the feed direction Z, said rotor is located opposite the carrying wheel 24, on the other side of the feed conveyor 12, and the length of the pressure-exerting elements 60 is selected such that they preferably act on the products 14 over the entire width of the same. The rotor 64 is driven about its axis of rotation 64' in the direction of rotation R of the rotor, which runs in the same direction as the direction of circulation U of the carrying wheel 24. Said rotor drive has a superposed rotary drive for the pivot levers 62, this rotary drive rotating these pivot levers, as the rotor 64 revolves, by a full revolution in the opposite direction of rotation, with the result that the pressure-exerting elements 60 circulate along an elliptical movement path 66, which crosses over the circulatory path 26. The rotation of the rotor 64 is synchronized with the rotation of the carrying wheel 24 such that in each case one pressure-exerting element 60—along the movement-path section which is directed toward the feed conveyor 12—crosses over the circulatory path 26 radially from the inside to the outside, in relation to the axis 24', approximately centrally between two adjacent grippers 22 and then crosses the circulatory path 26 from the outside to the inside, to be precise between that gripper of the abovementioned two grippers 22 which follows in the direction of circulation U and the following gripper. In this case, as can be seen from FIG. 4, the pressure-exerting element 60 is positioned against the outer side, as seen in the radial direction, of the product 14 retained by the preceding gripper 22 and forces said product, the latter being bent around the pressure-exerting element 60 and drawn around the following gripper 22, radially inward until the entire product 14 is located radially within the following gripper 22. In this case, the pressure-exerting element which follows this pressure-exerting element 60 lifts the product 14 in its end region which is directed away from the gripper 22, which helps to ensure that the product is treated carefully. The following transfer, to the removal conveyor 38, of the products 14 which have had their imbricated formation changed in this way takes place as has been described above. This embodiment is advantageously used when, measured in the direction at right angles to the axis 24', the products 14 are very much larger than the distance between successive grippers 22.

Figure 5:
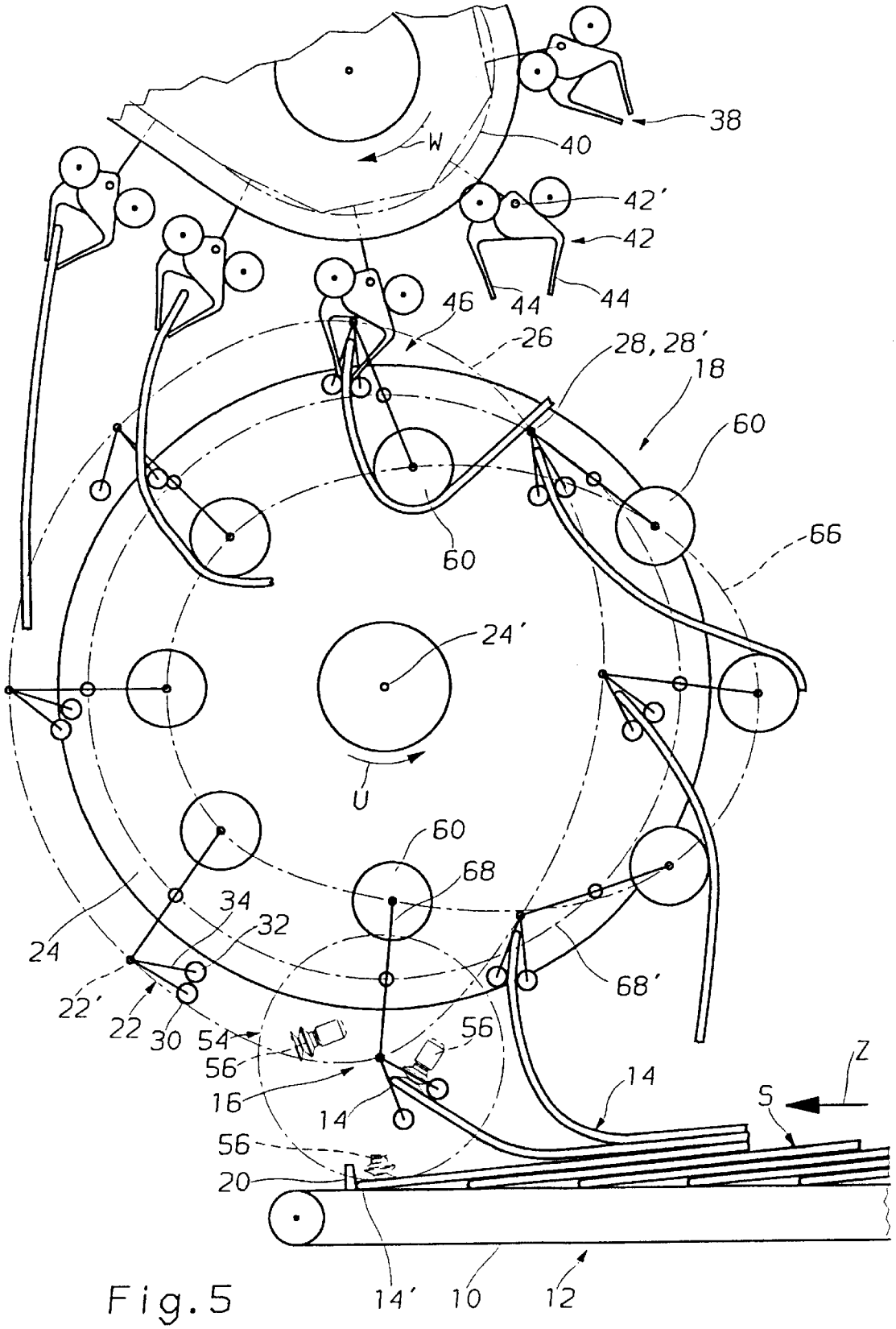
FIG. 5 shows, in elevation, a further embodiment of the apparatus, in which each gripper of the intermediate conveyor is assigned a pressure-exerting element.

In that embodiment of the apparatus which is shown in FIG. 5, each gripper 22 of the intermediate conveyor 18 is assigned a pressure-exerting element 60. Each pressure-exerting element 60 is arranged at one end of a two-armed lever 68, at the other end of which the associated gripper 22 is mounted. The two-armed levers 68 are mounted pivotably on the carrying wheel 24, which is driven in rotation in the direction of circulation U, and are distributed uniformly along a circle 68', which is coaxial with the respect to the axis 24'. A pivot control means 70, as is shown in FIG. 6, pivots the two-armed levers 68, on the one hand, and the grippers 22, on the other hand, in dependence on the rotary position of the carrying wheel 24. The pivot axes 22' of the grippers 22 thus circulate along the circulatory path 26, which in this case is no longer circular. The movement path of the pressure-exerting elements 60 is designated by 66.

Terminating beneath the intermediate conveyor 18 is the feed conveyor 12, which is designed as a belt conveyor 10 and intended for feeding the products 14 to the receiving location 16, in the feed direction Z, in an imbricated formation S in which, once again, each product 14 rests, in the manner of roof tiles, on the following product. Once again, the products 14 pass into abutment against a stop 20 by way of their leading edge 14', and from this stop they are lifted individually by means of a sucker arrangement 54 in order to be gripped by a gripper 22 and peeled off in the upward direction from the following product 14. As they run into the receiving location 16, the rectilinear two-armed levers 68 run approximately in the radial direction, the pressure-exerting element 60 being located radially on the inside and the gripper 22 being located radially on the outside. As the product 14, which is lifted by a suction head 56, is received, and once it has been received, the gripper 22 is pivoted, counter to the direction of rotation U, from a pivot position in which it is directed approximately in the tangential direction and counter to the feed direction Z, in order for the product 14 to be peeled off, with bending action, from the following product. Between the receiving location 16 and the transfer region 46, the two-armed lever 68 is rotated through approximately half a rotation, counter to the direction of circulation U, out of its radially running position, with the result that in the transfer region 46, which is located diametrically opposite the receiving location 16, the pressure-exerting element 60 is again located on the inside and the gripper 22 is located on the outside. By virtue of this rotation of the two-armed levers 68, the pressure-exerting element 60, downstream of the receiving location 16, moves through radially outward between the associated gripper 22 and the gripper preceding this and then moves through radially inward again between the associated gripper 22 and the following gripper. With this radially inwardly running movement of the pressure-exerting element 60, the latter comes into a abutment against the radially outer side of the product 14 retained by the associated gripper 22 and moves said product, with bending action, radially inward, the product first of all being drawn around the pressure-exerting element 60 assigned to the following gripper 22 and then being drawn around the supporting element 28' of said gripper. In order to assist this movement, the gripper 22, at the same time, is pivoted, counter to the direction of circulation U, into a position in which it is directed radially inward. As a result of the intersection of the circulatory path 26 and the movement path of the clamps 42, the product 14—as is also the case in the embodiments described above—passes into the interior of a clamp 42 of the removal conveyor 38 by way of a section which adjoins the edge 14'. Between the transfer region 46 and the receiving location 16, as seen in the direction of circulation U, the position of the two-armed lever 68 is maintained at least virtually unchanged in the radial direction and the gripper 22 is pivoted out of its radially inwardly directed position into the position in which it runs at least approximately tangentially and in the forward direction, in order then, at the receiving location 16, to be able to grip a further product 14.

FIG. 6 shows a plan view of the carrying wheel 24, which is mounted on a machine framework 72 such that it can be rotated about the axis 24', as well as part of the pivot control means 70 in section and, in order to give a better overall view, a single gripper 22 of that embodiment of the apparatus which is shown in FIG. 5, along with the associated pressure-exerting element 60. Also shown is the product 14 which is butting against the stop 20 by way of its leading edge 14' and is to be lifted by means of the suction head 56, indicated by chain-dotted lines, of the sucker arrangement 54, in order then to be gripped by a gripper 22. Chain-dotted lines indicate the feed conveyor 12 at the point when the products 14 are fed to the receiving location 16 counter to the feed direction Z, in which case the edge 14', which is to be gripped by the gripper 22, is the trailing edge.

Fastened at one end of the two-armed lever 68 is the, for example, tubular pressure-exerting element 60, which extends beyond the products 14 on both sides, as seen in the direction at right angles to the feed direction Z. At the other end of the two-armed lever 68, the gripper 22 is mounted such that it can be pivoted about the pivot axis 22'. A gear wheel 76 is mounted in a freely rotatable manner on a hollow shaft stub 74, which is coaxial with respect to the pivot axis 22' and projects from the two-armed lever 68, and a carrying disk 78 is fastened on that end side of said gear wheel which is directed away from the lever 68. Said carrying disk, coaxially with respect to the pivot axis 22', bears a sleeve 80 on which there is fastened one end of the helical closing spring 36, which, at the other end, acts on the lever 34, which is fixed at one end of a lever shaft 82, which engages in a rotatable manner through the closing spring 36, the sleeve 80, the carrying disk 78, the gear wheel 76, the hollow shaft stub 74 and the two-armed lever 68 and, at the other end, bears an opening lever 84. Mounted in a freely rotatable manner at the free end of said opening lever 84 is an opening roller 86, which is intended for interacting with an opening guide 88, which is fixed on the machine framework 72, in order to pivot the gripper jaw 32 into the open position counter to the force of the closing spring 36.

In addition, fastened on the carrying disk 78 outside the sleeve 80 and the closing spring 36, as seen in the radial direction, is a bar 90 which runs parallel to the pivot axis 22' and, at its free end, bears a disk 92 which is centric with respect to the pivot axis 22' and on which the shaft 28 is fastened coaxially with respect to the pivot axis 22'. Fastened at the free end of said shaft 28 is the gripper tongue 30, which projects radially and axially from said shaft in the manner of a lug and, axially adjoining the shaft 28, has a recess 94 in which, in the transfer region 46, the clamps 42 can engage. This recess 94 makes it possible for the circulatory path 26 of the grippers 22 and the movement path of the clamps 42 to intersect. The radial, free end region of the gripper tongue 30 interacts with the gripper jaw 32, which is of bar-like design. A product 14 retained by the gripper 22, and the edge 14', are indicated by dashed lines. This embodiment of the gripper 22 makes it possible for the products 14 to be introduced between the gripper tongue 30 and the pivoted-open gripper jaw 32 with the edge 14' in front and for the product 14 to be guided out again, between the shaft 28 and the gripper tongue 30 and the pivoted-open gripper jaw 32, with the edge 14' in front.

The gear wheel 76 meshes with a further gear wheel 76', which is seated in a rotationally fixed manner on a pivot shaft 96, which is coaxial with respect to the bearing axis 68' of the two-armed lever 68, engages through the carrying wheel 24 in a rotatable manner and bears an angle lever 98 at the other end. Mounted in a freely rotatable manner at both ends of the latter is in each case one follow-on roller 100, both of these rollers engaging in a groove 102 of a ring-like control disk 104. The latter is fastened on the machine framework 72 coaxially with respect to the axis of rotation 24' of the carrying wheel 24. The grooves 102, which run around the axis of rotation 24', are continuous and, in dependence on the rotary position of the carrying wheel 24, define the pivot position of the gripper 22. In order to allow a crossover of the grooves 102 and, nevertheless, to guide the angle lever 98 in a defined manner, the grooves 102 have different depths.

Engaging around the pivot shaft 96 is a hollow shaft 106 which is mounted in a freely rotatable manner on the carrying wheel 24 and which has the two-armed lever 68 fastened at one end and bears a cylindrical wheel 108 at the other end, this cylindrical wheel being arranged between the carrying wheel 24 and the angle lever 98. Said cylindrical wheel 108 meshes with an intermediate wheel 110 which is mounted in a freely rotatable manner on the carrying wheel 24 and, for its part, meshes with a further cylindrical wheel 112, which is likewise mounted in a freely rotatable manner on the carrying wheel 24. A further angle lever 98' is fastened on said cylindrical wheel 112, and said further angle lever, in the same way as the angle lever 98, bears follow-on rollers 100' at its two ends, these rollers, for their part, each being guided in a further groove 102'. It is thus the case that, in dependence on the rotary position of the carrying wheel 24, said further grooves 102' control the pivot position of the two-armed lever 68.

In all the examples shown, the supporting element 28' is arranged on the gripper 22 itself. However, it is also conceivable in principle for the supporting element 28', which is assigned to each gripper 22 individually, to be arranged separately from the gripper; however, the supporting element is always used for supporting the product 14' as it is drawn around the associated gripper 22.

In the embodiment shown in FIGS. 1 to 4, the pivot control means may be designed on fundamentally the same basis as in the embodiment shown in FIGS. 5 and 6, it then being the case, of course, that only the grooves which are necessary for the purpose of pivoting the grippers 22 are provided and the elements which serve for pivoting the two-armed lever 68 are omitted.

If it is also intended for the apparatus to process products which arrive in an irregular imbricated formation, it is possible for a small intermediate stack, which is supplied from beneath, to be formed in a known manner at the receiving location, in each case the uppermost product being lifted off from said intermediate stack by means of the sucker arrangement.

That which is claimed:

1. An apparatus for processing flexible sheet-like products comprising a feed conveyor for supplying the products to a receiving location, an intermediate conveyor which includes a plurality of pivotably controlled grippers arranged for movement serially along a continuous circulatory path in a direction of circulation, with each of said grippers including means for gripping a leading product from the feed conveyor and for guiding the gripped product around the following gripper in the direction of circulation so that the gripped product moves from one side of the following gripper to the other side as the gripped product moves along the continuous circulatory path, and such that the sequence of the products remains intact and the mutually facing sides of adjacent products are reversed, and a removal conveyor arranged downstream of the intermediate conveyor for receiving the products from the grippers and conveying them away.

2. The apparatus as claimed in claim 1, wherein each gripper includes a supporting element around which the product retained by the respectively preceding gripper, as seen in the direction of circulation, is drawn.

3. The apparatus as claimed in claim 1, wherein the means for guiding the products around the following grippers include control means which pivot the grippers out of a position in which the relevant product is arranged on one side of the respectively following gripper into a position in which the product is arranged on the other side of the following gripper.

4. The apparatus as claimed in claim 1, wherein the means for guiding the products around the following grippers include a pressure-exerting element which is driven in circulation along a continuous movement path, it being the case that the movement path crosses over the circulatory path of the grippers, and the pressure-exerting element, for drawing the respective product around the following gripper, passes into abutment, between the following gripper and the gripper which is retaining the product, against that side of the product which is directed away from the following gripper.

5. The apparatus as claimed in claim 4, wherein each gripper is assigned a pressure-exerting element and the latter circulates together with the associated gripper.

6. The apparatus as claimed in claim 5, wherein each gripper is mounted at one end of a two-armed pivotably controlled lever, at the other end of which the pressure-exerting element is fastened.

7. The apparatus as claimed in claim 4, wherein a plurality of pressure-exerting elements, which are independent of the grippers, circulate one behind the other along the movement path, in each case one pressure-exerting element moving through between two successive grippers.

8. The apparatus as claimed in claim 4, wherein each pressure-exerting element has a circular-cylindrical design, the latter running transversely with respect to the movement path.

9. The apparatus as claimed in claim 1, which further comprises a carrying wheel which is driven in rotation about its axis and on which the grippers are mounted at regular intervals in the form of a circle around the axis.

10. The apparatus as claimed in claim 1, wherein the feed conveyor has a belt conveyor which is intended for feeding the products in an imbricated formation in which each product rests on the respectively following product, and wherein a sucker arrangement is provided for lifting the products which are fed by means of the belt conveyor, individually into the movement path of the grippers.

11. The apparatus as claimed in claim 1, wherein the feed conveyor includes a clamp-type transporter having a plurality of the transporting clamps from which the grippers receive the products directly in a hanging position.

12. The apparatus as claimed in claim 1, wherein each gripper has a shaft which runs coaxially with respect to a pivot axis of the gripper and forms a supporting element at the end of which, in the manner of a single-armed lever, a gripper tongue is fastened, and wherein a gripper jaw, which runs parallel to the pivot axis and interacts with the gripper tongue, is arranged on a lever, which can be pivoted about the pivot axis.

13. The apparatus as claimed in claim 1, wherein the removal conveyor includes a plurality of clamps, and wherein the direction in which the products are introduced into the grippers is the same as the direction in which the products gripped by the clamps of the removal conveyor are drawn out of the grippers.

* * * * *